US007796917B2

(12) United States Patent
Wazana et al.

(10) Patent No.: US 7,796,917 B2
(45) Date of Patent: Sep. 14, 2010

(54) COLOR PRINTER TONER TRANSFER BELT SYSTEM AND PROCESS

(75) Inventors: Yoel Wazana, Chatsworth, CA (US); Sagie Shanun, Sherman Oaks, CA (US)

(73) Assignee: Wazana Brothers International, Van Nuys, CA (US)

( * ) Notice: Subject to any disclaimer, the term of this patent is extended or adjusted under 35 U.S.C. 154(b) by 125 days.

(21) Appl. No.: 12/168,552

(22) Filed: Jul. 7, 2008

(65) Prior Publication Data

US 2009/0016783 A1 Jan. 15, 2009

Related U.S. Application Data

(60) Provisional application No. 60/949,121, filed on Jul. 11, 2007.

(51) Int. Cl.
*G03G 15/00* (2006.01)
*G03G 15/16* (2006.01)

(52) U.S. Cl. ..... 399/121; 399/110; 399/303

(58) Field of Classification Search ..... 399/109, 399/110, 121, 162, 303, 313
See application file for complete search history.

(56) References Cited

U.S. PATENT DOCUMENTS

| | | | | |
|---|---|---|---|---|
| 6,304,737 | B1 * | 10/2001 | Dotschkal | 399/110 X |
| 6,970,669 | B2 * | 11/2005 | Mishra et al. | 399/162 X |
| 7,155,142 | B2 * | 12/2006 | Shifley et al. | 399/122 |
| 7,526,229 | B1 * | 4/2009 | Liu et al. | 399/162 X |
| 2002/0006292 | A1 * | 1/2002 | Kwak et al. | 399/162 X |
| 2009/0110435 | A1 * | 4/2009 | Spence et al. | 399/121 |

FOREIGN PATENT DOCUMENTS

| | | | |
|---|---|---|---|
| JP | 06-186896 A | * | 7/1994 |
| JP | 2001-132806 A | * | 5/2001 |

* cited by examiner

*Primary Examiner*—Sophia S Chen

(57) ABSTRACT

A system and method to replace a transfer belt of a color laser printer transfer belt assembly without replacing the entire assembly, including one or more novel holding fixtures and a method for releasing the tension on the transfer belt prior to removal of the transfer belt from the assembly, then reapplying tension to a replacement transfer belt and, optionally, replacing the motor assembly and/or the microchip that controls operation of the transfer belt assembly.

1 Claim, 3 Drawing Sheets

COLOR PRINTER TONER TRANSFER BELT SYSTEM AND PROCESS

CROSS-REFERENCE TO RELATED APPLICATIONS

This application is a utility patent application based on, incorporates by reference and claims the benefit of priority of U.S. provisional patent application 60/949,121, filed Jul. 11, 2007.

FIELD OF INVENTION

The invention relates generally to the field of laser toner printers, and more specifically to repair and remanufacture color laser toner printer transfer belt assemblies.

BACKGROUND OF INVENTION

In recent years a plural color or full color image forming apparatus of the electro-photographic type, for example, laser color printers, there has been put into practical use a so-called in-line type image forming apparatus in which a plurality of photo-sensitive drums are arranged in a plane in conformity with respective colors arranged sequentially. Toner images of the respective colors are formed on respective photosensitive drums are successively super-imposed on a media, typically paper that is positioned on a transfer belt to thereby form a color image as the transfer belt and the media are advanced in a forward direction in the plane. The transfer belt is positioned around a plurality of rollers, each roller having its axis of rotation perpendicular to the plane in which the transfer belt moves as the color image is formed on the media.

U.S. Pat. No. 6,600,893 ("the '893 patent") describes a full-color image forming apparatus, also referred to as a full-color printer, as an example of a conventional electrophoto-printing; color laser printer including a conventional in-line transfer belt assembly.

The image forming assembly is provided with four image forming portions or sub-assemblies, often referred to as cartridges, e.g., a yellow image forming portion or yellow cartridge, a magenta image forming portion or magenta cartridge, a cyan image forming portion or cyan cartridge and a black image forming portion or black cartridge. Each of the cartridges also includes drum-shaped electro-photographic photosensitive members, referred to as drums that function as image bearing members.

Each drum is negatively charged and driven or rotated at a pre-determined speed through use of a stepper motor assembly. Primary chargers function to uniformly charge the surfaces of the respective drums to a predetermined potential of negative polarity. Each cartridge contains the toner therein and, during operation causes the toner of each color to adhere to an electrostatic latent image formed on each drum to thereby develop the latent image as a toner image.

The transfer rollers as transferring means are disposed in respective transferring portions or zones so as to be capable of contacting with the respective drum with the intermediate transfer belt interposed there between.

The transfer belt is passed over two belt-conveying rollers. This transfer belt is formed of dielectric resin such as polycarbonate, polyethylene terephtalate, resin film or polyvinylidene fluoride resin film.

The toner image is transferred directly to the transfer belt through the transferring rollers with the media interposed there between the transfer belt and the drums, thus forming a color image with un-fixed, pre-melted toner powder. The media with the pre-melted toner powder then moves on to the fuser rollers, which in turn fuse the toner by means of heat onto the paper and thus fixing it.

The transfer belt apparatus is, usually, an easy to remove mechanism that has to be replaced once a certain amount of cartridges has been used or when it is damaged. Normally, if not damaged, the printer will notify the user when it is time to replace the transfer apparatus. On some printers, once the message appears, it is possible to reset the unit again. In some models, though there is no option to reset the printer and failing to replace the unit will end-up in inability to print. Prior experience shows that on the models that the transfer unit can be reset the printer can function with reasonable performance for a great deal of time without replacing the transfer unit.

Failure to replace the transfer unit for a long period of time might cause poor transfer efficiency thus poor print result. Moreover, excess use of the transfer unit might cause complete failure of the transfer belt, which might cause a permanent damage to the printer or the cartridges.

SUMMARY OF THE INVENTION

The presently disclosed system and methods overcome the drawbacks of conventional color laser printers, particularly in regard to transfer belt assembly repair and replacement by providing structures and methods for replacing a transfer belt without the need to replace the entire transfer belt assembly.

It is an object of the present invention to provide a method and process for repairing and remanufacturing a transfer belt apparatus for color laser toner printers in which the original, worn out or damaged transfer belt is replaced with a new transfer belt.

It is also an object of the present invention that a method for resetting the counter on the transfer belt assembly can be reset or replaced in order to allow for operation of the transfer belt assembly in a way that will yield printing operation that meets OEM specifications.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

Figure 1:
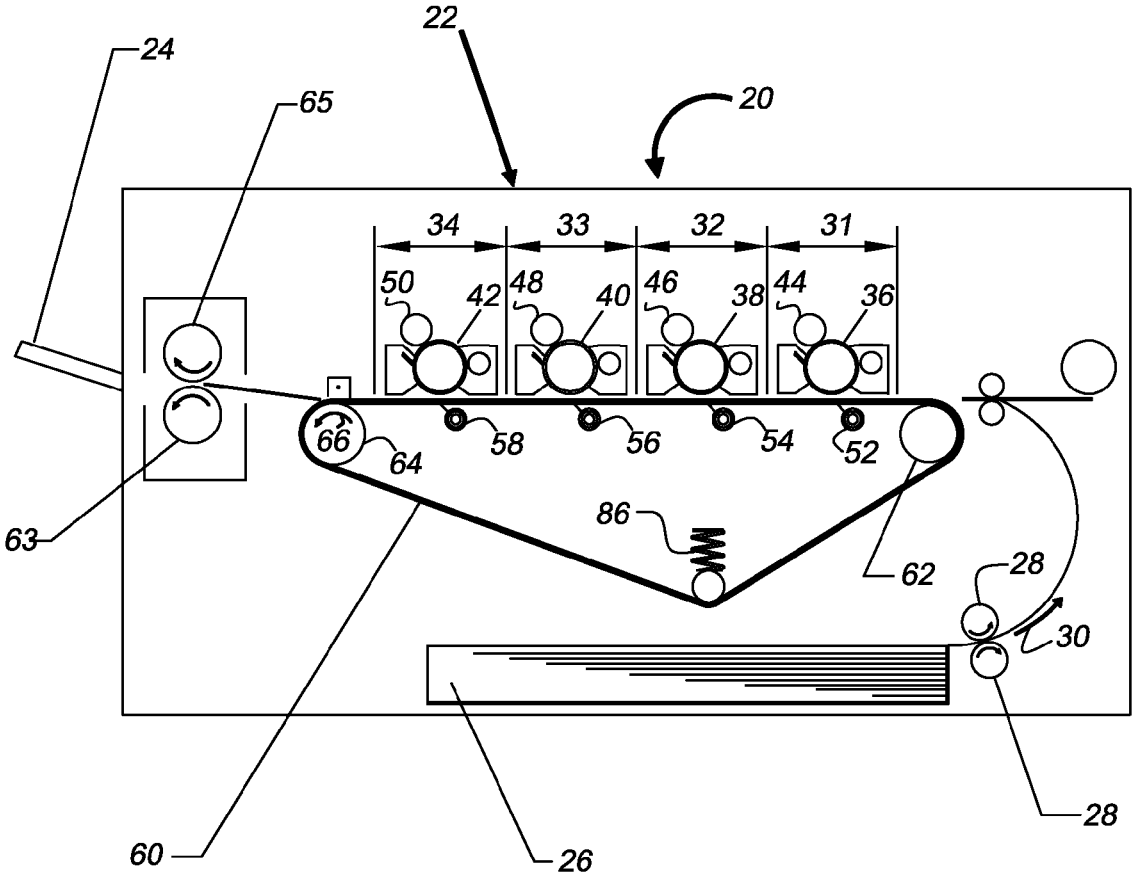
FIG. 1 is cross-sectional, schematic view of a color laser printer illustrating the major components of the multi-color cartridges and transfer belt assembly.

Referring to FIG. 1 a cross-sectional, schematic view of a color laser printer, image-forming apparatus 20 is shown. Also, for convenience the major components of the printer will be described with reference to an x-y-z axis Cartesian coordinate system. Details of the construction and operation of a printer of the type shown in FIG. 1 may be found in the '893 patent. The printer 20 includes a housing 22 and a media exit shelf 24. Typically the media is paper and shelf or tray 24 is referred to as the paper exit shelf or tray 24. The printer also includes an internal paper feed tray 26 that generally lie in an x-z plane, with the x directions going from left to right, and the z directions going into and out of the page as shown in FIG. 1. The y directions go from bottom to top in FIG. 1. Pick-up rollers 28, 28 are shown with the paper feed in the direction of arrow 30. The axes of rotation of the rollers 28, 28 extend into the page of FIG. 1 in the z direction.

The printer 20 is provided with four image forming portions or cartridges portions that extend along in distances or regions 31, 32, 33 and 34 in the x direction: the yellow portion or region 31 having a cartridge with yellow toner; the magenta portion or region 32 having a cartridge with magenta toner; the cyan portion or region 32 having a cartridge with cyan toner; and a black portion or region 34 having a cartridge with black toner. The order of the color can vary. Drum-shaped electro-photographic photosensitive members, referred to as drums, are shown at 36, 38, 40 and 42, and each of the axes of rotation extends into the page in the z direction. These drums function as image bearing members.

Each of the drums 36, 38, 40 and 42 is negatively charged by a corresponding primary charge roller, 44, 46, 48 and 50, respectively, and driven at a pre-determined speed. The axis of rotation of each primary charge roller also extends into the page in the z direction as shown in FIG. 1. The primary charge rollers, also known as primary chargers function to charge the surfaces of the corresponding, respective drums to a predetermined, uniform electrical charge of negative polarity. During operation each developing device, i.e., cartridge contains the respective colored toner and causes the toner of each color to adhere to an electrostatic, latent image formed on each drum. This latent image then becomes, or is developed into a toner image.

Transfer rollers 52, 54, 56 and 58 are positioned below transfer belt 60 and each of these rollers also has an axis of rotation that extends in the z direction, i.e., into the page as shown in FIG. 1. The transfer rollers disposed in the respective transferring portions or zones so as to be capable of cooperating with their respective drums on the opposite side of transfer belt 60. As shown in FIG. 1, the transfer belt 60 moves in a direction left to right, and extends in an x-z plane. The cartridges are positioned above the transfer belt in the y direction and the transfer rollers are below the cartridges, with the transfer belt interposed in between.

Figure 2:
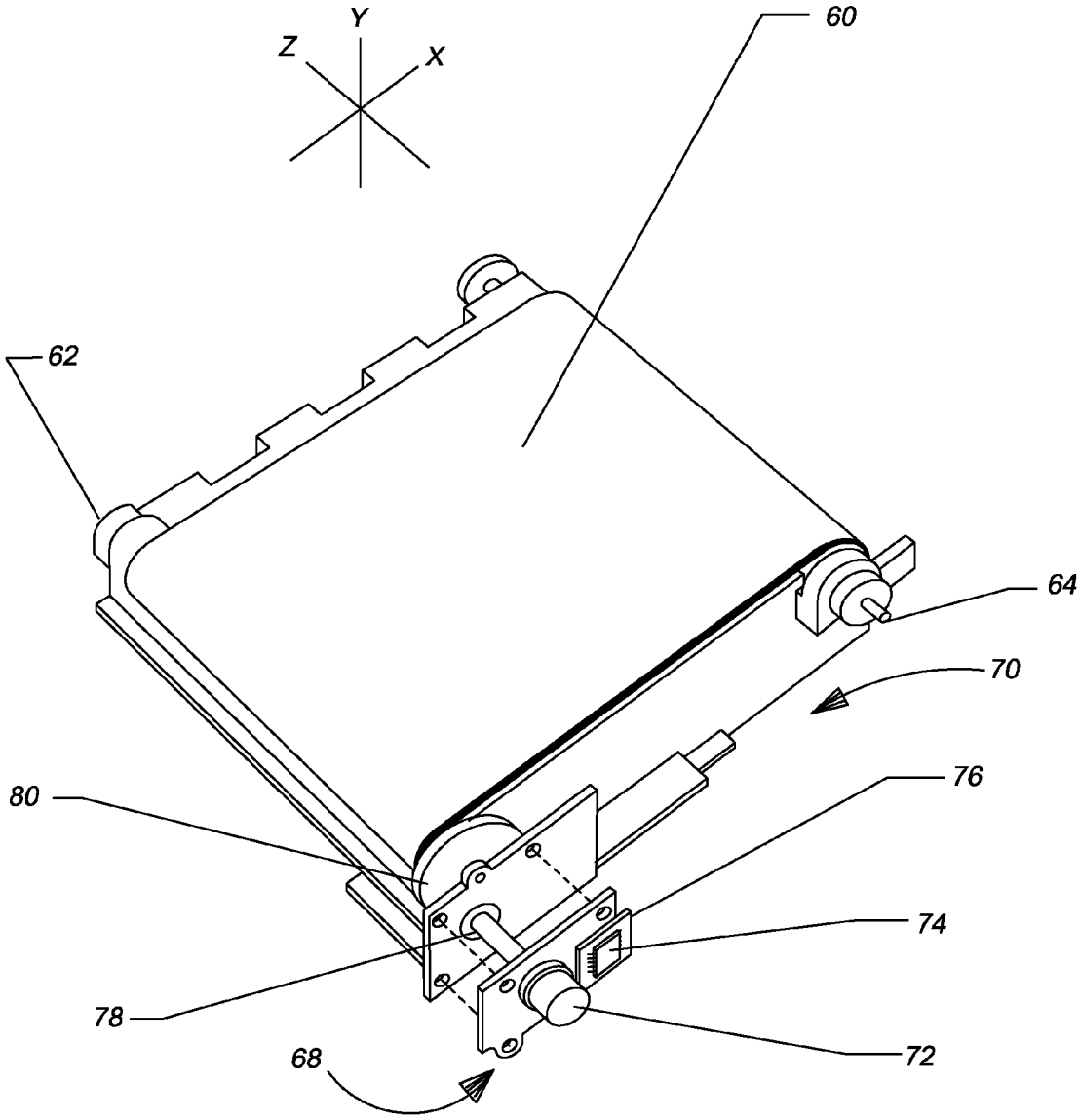
FIG. 2 is a perspective view of the transfer belt assembly of FIG. 1; and, FIG. 3 is a perspective view of the transfer belt assembly of the type shown in FIG. 1 and positioned in a belt replacement jig.

As shown in FIG. 2 stepper motor assembly 68 is attached to transfer belt apparatus housing 70. The assembly 68 includes stepper motor 72 and a microchip 74 mounted on board 76. Drive shaft 78 and gear 80 for the motor 72 are also shown in FIG. 2, with drive shaft 78 extending along in the z-direction. Transfer belt 60 is shown in an x-z plane, in FIG. 1.

The transfer belt 60 is an endless loop type belt that is passed over two belt conveying rollers 62 and 64 as shown in FIGS. 1-2. These rollers rotate in the direction shown with arrow 66 in roller 64 in FIG. 1. Their axes of rotation also extend in the z-direction in FIG. 1. The transfer belt is formed of a dielectric resin such as polycarbonate, polyethylene terephtalate, resin film or polyvinylidene fluoride resin film.

During operation the toner image on each of the drum 44, 46, 48 and 50 in FIG. 1 is transferred directly to the media, typically paper, that is positioned on the transfer belt. This image transfer takes place through operation of the transfer rollers and together these components cooperate to form a color image with one or more layers of un-fixed, pre-melted toner powder forming an image on the paper as the transfer belt moves right to left through the various cartridge regions 31-34 as shown in FIG. 1. The paper with the pre-melted toner powder then moves on to fuser rollers 63 and 65 as shown in FIG. 1. The fuser rollers heat the toner in each of the various layers sufficient to cause the toner to fuse to the paper, and thus fix the color image to the paper.

The transfer belt assembly apparatus is removable from the printer housing for repair and/or replacement once a certain amount of cartridges has been used or when the belt on any other component in the assembly has been damaged. Typically, during normal operation the printer will notify the user when it is time to replace the transfer apparatus, with this notification based on the number of counts of rotation of the stepper motor. On some printers, once the message appears, it is possible to reset the counter so that the printer will operate again. In some models no reset option is provided to reset the printer. For those models, failing to replace the transfer belt assembly will means that the printer will not be operable to print. It is believed that for the models of printers in which the transfer belt assembly counter can be reset, those printers can function with reasonable performance for a significant time without a need to replace the transfer belt assembly.

Failure to replace the transfer unit for a long period of time might cause poor transfer efficiency and thus poor quality printing. Moreover, excessive use of the transfer belt assembly could cause complete failure of the transfer belt assembly, which in turn could cause permanent damage to the printer or to one or more of the cartridges.

Figure 3:
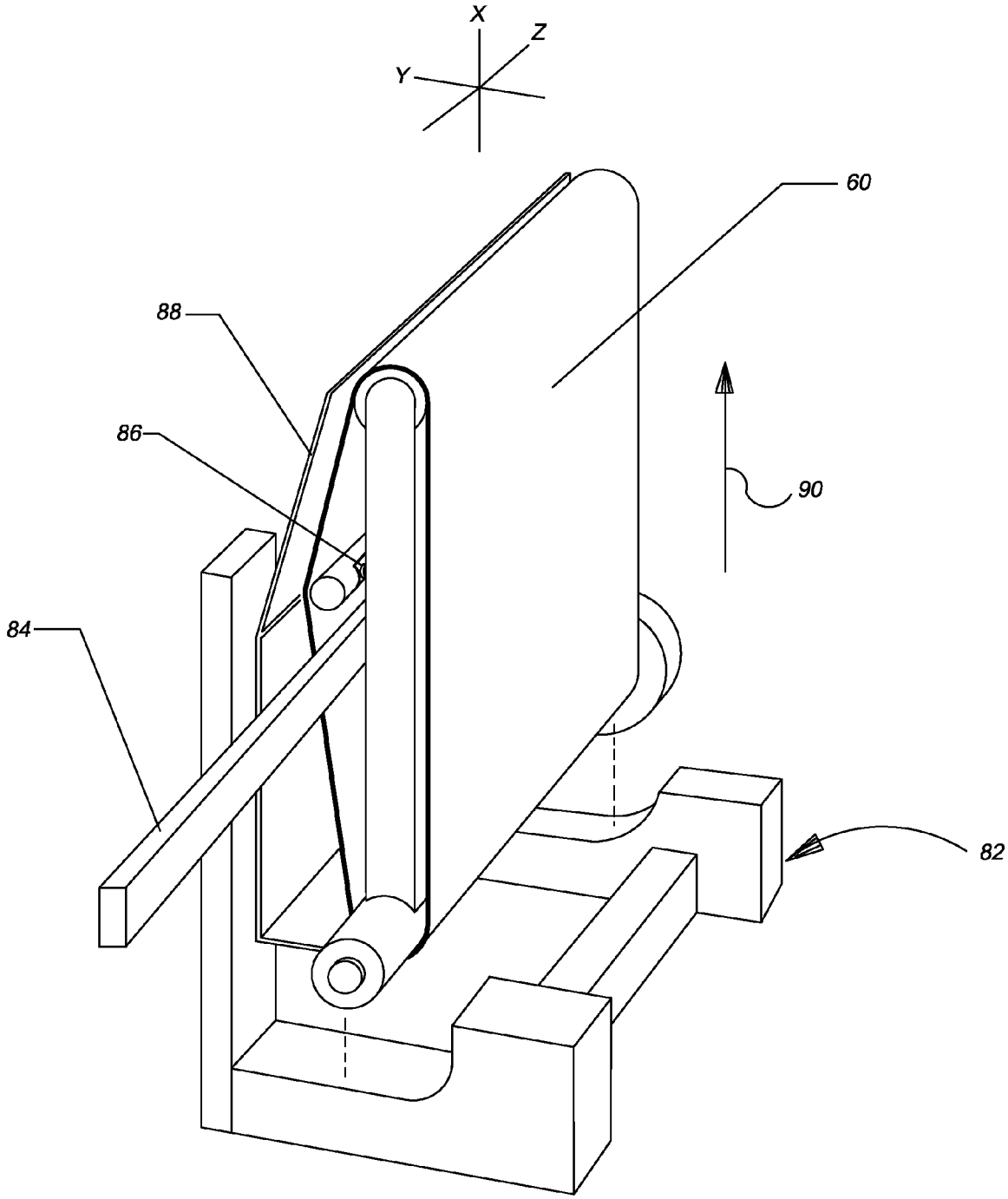

With reference to FIG. 3 a preferred embodiment of a holding fixture and method of transfer belt replacement will be described. First a spent or damaged transfer belt assembly is removed from the printer housing. Next the original transfer belt is removed through use of a novel holding fixture and process. Shown in FIG. 3 is a novel first holding fixture 82 that holds the transfer belt assembly in a vertical position. During the repair operation and simultaneously with removal of the belt 60, a bar 84 is slid into the transfer belt assembly in the z-direction and adjacent the spring-biased or loaded tensioning roller 86. The spring tension release bar 84 is mounted on a second fixture, not shown. The second fixture is a structure that moveably holds or engages the bar 84 and permits movement of the bar 84 in the x-direction to move roller 86 to relieve or remove the spring tension that maintains tension on the transfer belt 60. The spring-loaded roller 86 is also shown in FIG. 1. This operation releases tension on the belt and allows removal of the transfer belt 60 from the transfer belt housing 88 in a way that minimizes the potential for damaging the transfer belt and maximizing removal speed and efficiency.

Once the belt 60 has been removed from the assembly, a replacement belt is installed by reversing the order of actions described above. For convenience of disassembly and reassembly, the holding fixture positions the transfer belt assembly vertically, as shown by arrow 90 pointing in the x-direction in FIG. 3. Bar 84 can also be integrated into the fixture 82 in order to permit pulling back the spring loaded rollers 86, known also as tension rollers, that create the tension on the belt, in order to pull the old transfer belt out and to install the replacement transfer belt. The sides of the replacement belt are placed in the designated slots of two guide ribs, not shown, to prevent sideways slipping of the transfer belt during operation. Also, the motor assembly 68 and/or the microchip 74 can be removed and replaced with new or repaired components.

The bar 84 functions to permit replacement of the transfer belt 60 without disassembling the springs of the spring loaded roller 86. In the absence of use of the bar 84, replacement of the transfer belt would require bending of the transfer belt and that in turn has the potential of causing damage to the transfer belt, ultimately causes problems with printing quality.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method for replacing a transfer belt in a transfer belt assembly of a color laser printer having a transfer belt, at least two conveying rollers and one tensioning roller comprising:

providing a holding fixture, the fixture adapted to hold the assembly in a fixed position and with the conveying rollers axes of rotation lying in a horizontal plane;

placing a color laser printer transfer belt assembly in the holding fixture with the conveying rollers axes of rotation lying in a horizontal plane;

providing a bar capable of movement relative to the holding fixture;

placing the bar adjacent the tensioning roller;

moving the bar against the tensioning roller sufficient to release tension on the transfer belt;

removing the transfer belt from around the conveying rollers;

installing a replacement transfer belt around the conveying rollers;

moving the bar to place tension on the replacement transfer belt;

moving the bar away from the tensioning roller; and removing the transfer belt assembly from the holding fixture.

* * * * *